US006610971B1

(12) United States Patent
Crabtree

(10) Patent No.: US 6,610,971 B1
(45) Date of Patent: Aug. 26, 2003

(54) SHIP SELF-DEFENSE MISSILE WEAPON SYSTEM

(75) Inventor: Daniel Crabtree, Ridgecrest, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/139,545

(22) Filed: May 7, 2002

(51) Int. Cl.[7] ..... F41G 7/00

(52) U.S. Cl. ..... 244/3.1; 244/3.11; 244/3.14; 244/3.15; 244/3.16; 244/3.21

(58) Field of Search ..... 244/3.1–3.3; 89/1.8–1.82, 89/1.11, 1.51

(56) References Cited

U.S. PATENT DOCUMENTS

| | | | | |
|---|---|---|---|---|
| 2,981,152 A | * | 4/1961 | Miller, Jr. et al. | 89/1.805 |
| 4,161,301 A | * | 7/1979 | Beardsley et al. | 89/1.51 |
| 4,208,949 A | * | 6/1980 | Boilsen | 89/1.801 |
| 4,363,257 A | * | 12/1982 | Harris et al. | 89/1.802 |
| 4,923,148 A | * | 5/1990 | Fillingham et al. | 89/1.51 |

OTHER PUBLICATIONS

P. Garnell, *Guided Weapon Control Systems*, Second Edition—Chapter 9, "Proportional Navigation and Homing Guidance Loops" pp. 198–205.

William L. Wolfe and George J. Zissis, *The Infrared Handbook*, Revised Edition—pp. 22–63 through 22–78.

John H. Blakelock, *Automatic Control of Aircraft and Missiles*, Second Edition—Chapter 7, "Missile Control Systems" pp. 229–251 and Appendix G, pp. 611.

*Transfer alignment Methods Study For Air Launched Missiles*, Document No. NWC–005–005–2 dated Apr. 30, 1990 under contract No. N60530–87–D–0154; Prepared for: Naval Weapons Center, China Lake, CA; Prepared by: Strapdown Associates, Inc.

Yaakov Bar–Shalom and Xiao–Rong Li, *Estimation and Tracking Principles, Techniques, and Software*; pp. 164–168.

* cited by examiner

*Primary Examiner*—Bernarr E. Gregory
(74) *Attorney, Agent, or Firm*—Anthony J. Serventi; Laura R. Foster

(57) ABSTRACT

The present invention provides a ship self-defense missile (SSDM) weapon system for launching a plurality of light weight missiles from an existing vertical tube launch infrastructure. The system for vertically launching missiles from a ship comprises a plurality of tiers having a top tier and a bottom tier in which tier supports a plurality of missiles. The tiers are set into a launch canister having an interior wall to form a vertical stack in the launch canister. A launch means is used for selectively launching at least one of the plurality of missiles from the top tier. A means for ejecting ejects the top tier is depleted of missiles. A vertical movement means raises and lowers the tiers within the launch tube and the vertical movement means raises next tier in the vertical stack into a position to launch. Preferably, the vertical movement means is a jack screw threaded though each tier in the vertical stack and the means for ejecting involves screwing a depleted tier off the jack screw and initiating explosives at the base of the depleted tier to allow the next tier access to a ready to fire position.

17 Claims, 7 Drawing Sheets

FIG 7

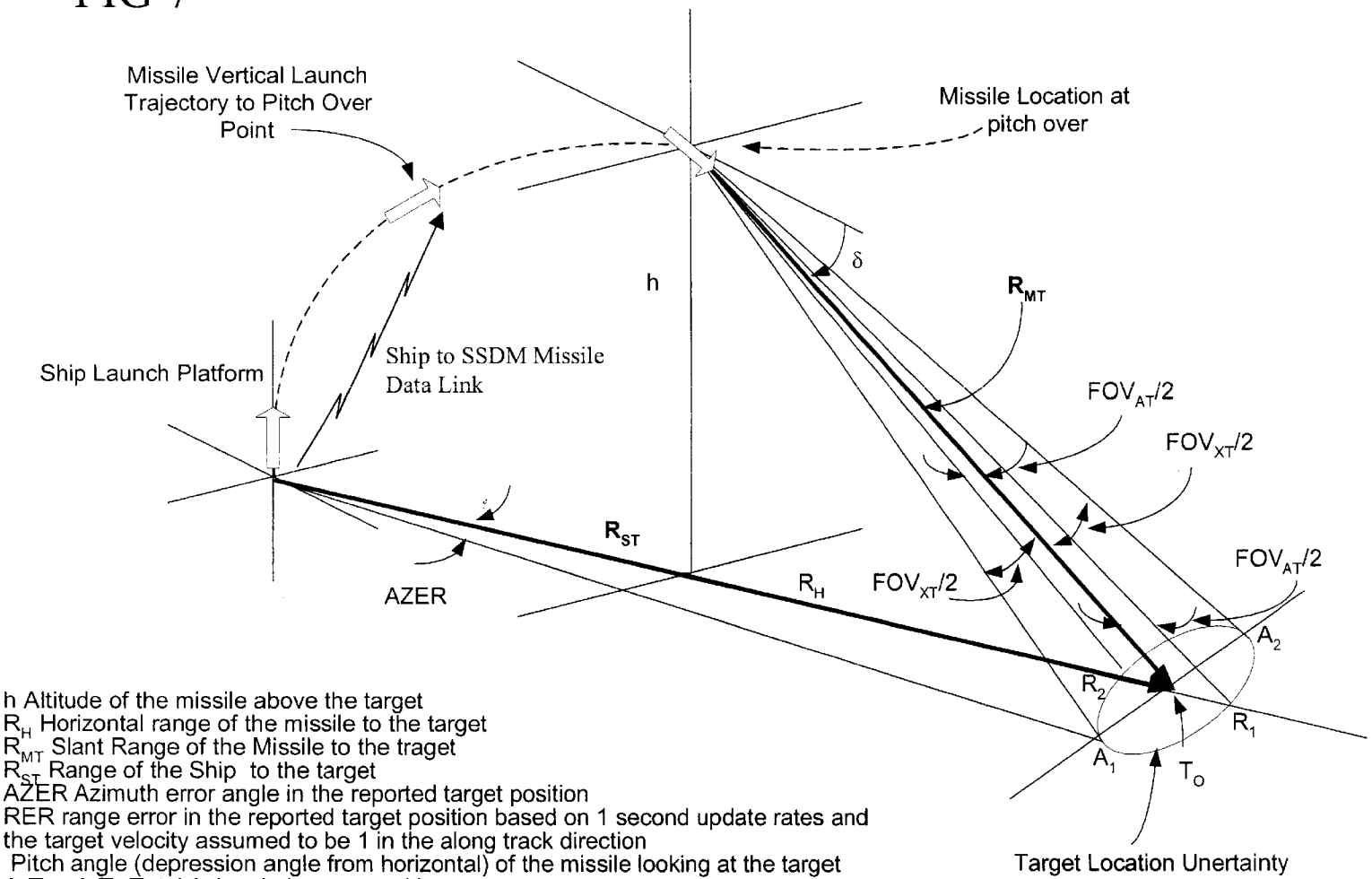

h Altitude of the missile above the target
$R_H$ Horizontal range of the missile to the target
$R_{MT}$ Slant Range of the Missile to the traget
$R_{ST}$ Range of the Ship to the target
AZER Azimuth error angle in the reported target position
RER range error in the reported target position based on 1 second update rates and the target velocity assumed to be 1 in the along track direction
Pitch angle (depression angle from horizontal) of the missile looking at the target
$A_1T_O = A_2T_O$ Total Azimuth 1 target position error.
$FOV_{XT}/2$ Half to Cross Track Field of View
$FOV_{AT}/2$ Half the Along Track FOV
$R_2T_O$ Total Near Edge along track error
$R_1T_O$ Total Far Edge along track error

SHIP SELF-DEFENSE MISSILE WEAPON SYSTEM

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

BACKGROUND OF THE INVENTION

1. Field of the Invention

The present invention relates to a multi-tiered vertical launched multi missile system. More particularly, the present invention is composed of low cost, light weight missiles housed in a multi-tiered vertical launch canister that utilizes existing vertical launch infrastructure useful for ships of the line that employ a vertical launch system useful for their self-defense. Most particularly, the missile system provides a means of engaging a swarm of small vessels simultaneously, with multiple missiles, with a very high rate of fire, in a cost effective manner.

2. Brief Description of the Related Art

Recent history has shown that while ships of the line generally have awesome firepower capability against both airborne threats and other ships of the line, they have very little capability to defend themselves against asymmetric threats in the form of small boats. These are typified by small boats such as jet skis, and speed boats that are determined to intercept and engage the warship at very close range. They can utilize large caches of onboard explosives or guided or unguided weapons to attack the ship. Guided and unguided threats can take the form of anti-ship cruise missiles, wire guided anti-tank rounds, rocket launchers, rocket propelled grenades as well as 50 caliber machine guns and 20 mm guns. Primarily, this is a problem that is encountered in littoral regions of the earth and regions where waterways and commercial shipping restrict the warships from both maneuvering and utilizing their existing weapons systems. One of the most severe asymmetric threat tactics that will need to be countered is described as the swarm tactic. This involves many small boats utilizing their high speed and maneuverability in attacking a warship in sufficient numbers so as to overwhelm, by shear numbers, any self defense capability the ship might have. Existing self defense systems on ships consist of layered point defense systems that can be composed of the following: helicopters firing Penguin Missiles, HELLFIRE™ Missiles, or utilizing a 20 mm chain gun, along with the Sea Whiz gattling gun point defense system, the 5 inch deck gun, the Rolling Airframe Missile, and possibly Standard missile, and tactical air defense or combinations of these. The fundamental deficiency in all of these potential responses is that they can be easily overwhelmed by shear numbers of threats. Another problem with these existing systems is the potential cost benefit of utilizing a very expensive weapon against many very cheap small boats. Still another problem is the inability to carry sufficient numbers of existing weapons or to reload in a timely manner to engage a swarm of small boats. Fundamentally, there is no point defense weapon in existence that has the capability to engage a swarm of small boats.

U.S. Pat. No. 6,347,567 entitled "Covert aerial encapsulated munition ejection system" issued on Feb. 19, 2002 to Eckstien discloses a system for launching precision guided munitions (PGMs), artillery rockets/missiles, and cruise missiles from an aircraft includes a mobile unit having a storage compartment provided with a rack assembly arranged to define multiple tiers for storing munition ejection containers (MECs) therein. However, the invention of the 6,347,567 Patent describes a portable system designed for use in an aircraft to attack several targets, rather than ship self-defense utilizing existing launch tubes.

In view of the foregoing, there is a need for a missile system that provides a means of engaging a swarm of small boats simultaneously, with multiple missiles, with a very high rate of fire, in a cost effective manner. The present invention addresses this need.

SUMMARY OF THE INVENTION

A preferred embodiment of the present invention provides a ship self-defense missile (SSDM) weapon system for launching a plurality of light weight missiles from an existing vertical tube launch infrastructure. The system for vertically launching missiles from a ship comprises a plurality of tiers having a top tier and a bottom tier in which tier supports a plurality of missiles. The tiers are set into a launch canister having an interior wall to form a vertical stack in the launch canister. A launch means is used for selectively launching at least one of the plurality of missiles from the top tier. A means for ejecting the top tier is activated after each missile contained within the top tier is launched. A vertical movement means raises and lowers the tiers within the launch canister and the vertical movement means raises the next tier in the vertical stack into a position to launch. Preferably, the vertical movement means is a jack screw threaded though each tier in the vertical stack and the means for ejecting involves screwing a depleted tier off the jack screw and initiating explosives at the base of the depleted tier to allow the next tier access to a ready to fire position.

The present invention includes a method of firing a light weight missile system comprising a vertical tube launching system comprised of multiple tiers per launch canister each tier containing multiple light weight missiles, housed in individual missile tubes, where each missile is composed of a guidance system having both aero-control section capable of altering the flight path of the missile to a target once the rocket motor has extinguished, a thrust vector control/thrust divert control for attitude control during initial ascent phase, a computer hardware package and algorithm capable of controlling the attitude during the launch phase and adjusting the aero-control section in relation to measured values, a data link receiver used to receive target location updates from the ship's fire control systems, a strap-down Infrared acquisition and tracking sensor electrically connected to the computer hardware package and algorithm, the sensor capable of providing a measured value to the computer hardware package and algorithm; a contact actuated ordinance section; and, a solid-propellant rocket motor of sufficient power to project the missile through a vertical ascent and to a speed and over a distance to enable the guidance system.

A preferred embodiment of the present invention includes a light weight missile, comprising a guidance system having both aero-control section capable of altering the flight path of the missile to a target once the rocket motor has extinguished, a thrust vector control system for attitude control during initial ascent phase, a computer hardware package and algorithm capable of controlling the attitude during the launch phase and adjusting the aero-control section in relation to measured values, a data link receiver used to receive guidance updates from the ship's fire control systems, a strap-down infrared acquisition and tracking sensor electrically connected to the computer hardware package and algorithm, the sensor capable of providing a measured value to the computer hardware package and algorithm; a contact actuated ordinance section; and, a solid-propellant rocket motor of sufficient power to project the missile through a vertical launch and to a speed and over a distance to enable the guidance system.

An object of a preferred embodiment of the present invention provides a system for vertically launching a plurality of missiles from an existing vertical tube launch infrastructure to ward off an attack from several small targets, such as gun boats or jet skis.

BRIEF DESCRIPTION OF THE DRAWINGS

FIG. 7 is a diagram showing the geometry of the engagement of the SSDM missile from launch and vertical ascent to impact on the target.

DETAILED DESCRIPTION OF THE PREFERRED EMBODIMENT

Figure 4:
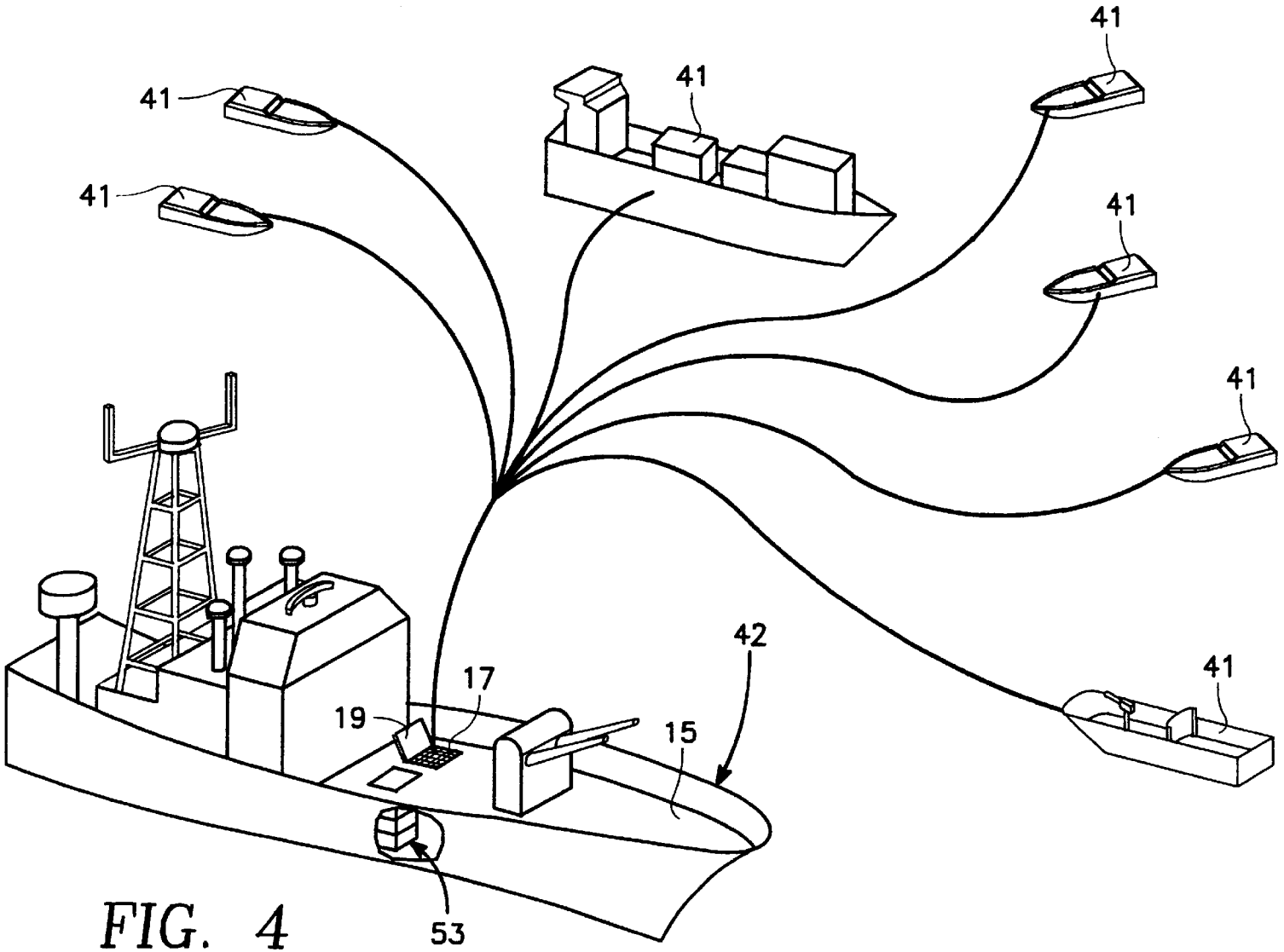
FIG. 4 is an illustration of a preferred embodiment of the present invention, which illustrates a multi-tiered vertical launched multi missile system, which may launch several ship self defense missiles simultaneously to combat an attack from several small vessels.

The present invention relates to light weight vertically launched guided missiles 11 launched from a vertical launching system. Referring to FIGS. 1*a*, 1*b*, 5*a* and 5*b*, the light weight missile 11 is small such that multiple missiles 11 can be loaded into a tier 10. A plurality of tiers form a vertical stack 12 and are loaded into a vertical launch canister 53 then placed an existing vertical launching system. When incorporated into a vertical launching missile system, the missile 11 is launched from a missile tube 16 of the top tier 17 of the multi tiered vertical stack 12 that is incorporated into the existing vertical launching infrastructure. The multi tiered approach with multiple missiles 11 per tier 10 allows the rapid rate of fire required to engage a swarm of small boats 41, as illustrated in FIG. 4. Arranging the missiles 11 vertically to form a vertical stack 12 has the advantage of efficient storage of many light weight missiles and their rapid deployment. For example, a cover 19 on the flight deck 15 of a ship 42 raises to allow deployment of missiles 11. Vertical launching also has the advantage of not requiring the missile 11 to be pointed along some nominal line of sight to a target since it can fly in any direction around the ship 42. The light weight missile 11 has the advantage of being inexpensive with the advantages of midcourse guidance updates from the ships existing fire control system infrastructure and to fly to an estimated target location and acquiring a surface target utilizing the infrared detector and associated target acquisition and tracking algorithms. Applicable algorithms for target acquisition of infrared target tracking can be found in publications such as "The Infrared Handbook, 3$^{rd}$ Edition," 1989, William L. Wolfe, Editor, George J. Zissis, Editor, The Infrared Information Analysis (IRIA) Center, Environmental Research Institute of Michigan. Methods of missile guidance can be found in publications such as "Guided Weapon Control Systems, 2$^{nd}$ Edition," 1980, P. Garnell, Pergamon Press, New York, N.Y. and "Automatic Control of Aircraft and Missiles, 2$^{nd}$ Edition," 1991, John H. Blackelock, John Wiley & Sons, Inc. New York, N.Y. The vertical launch 53 canister has the advantage of providing a means of storage and launch for the light weight missiles 11 while utilizing the ships vertical launching infrastructure.

Figure 1A:
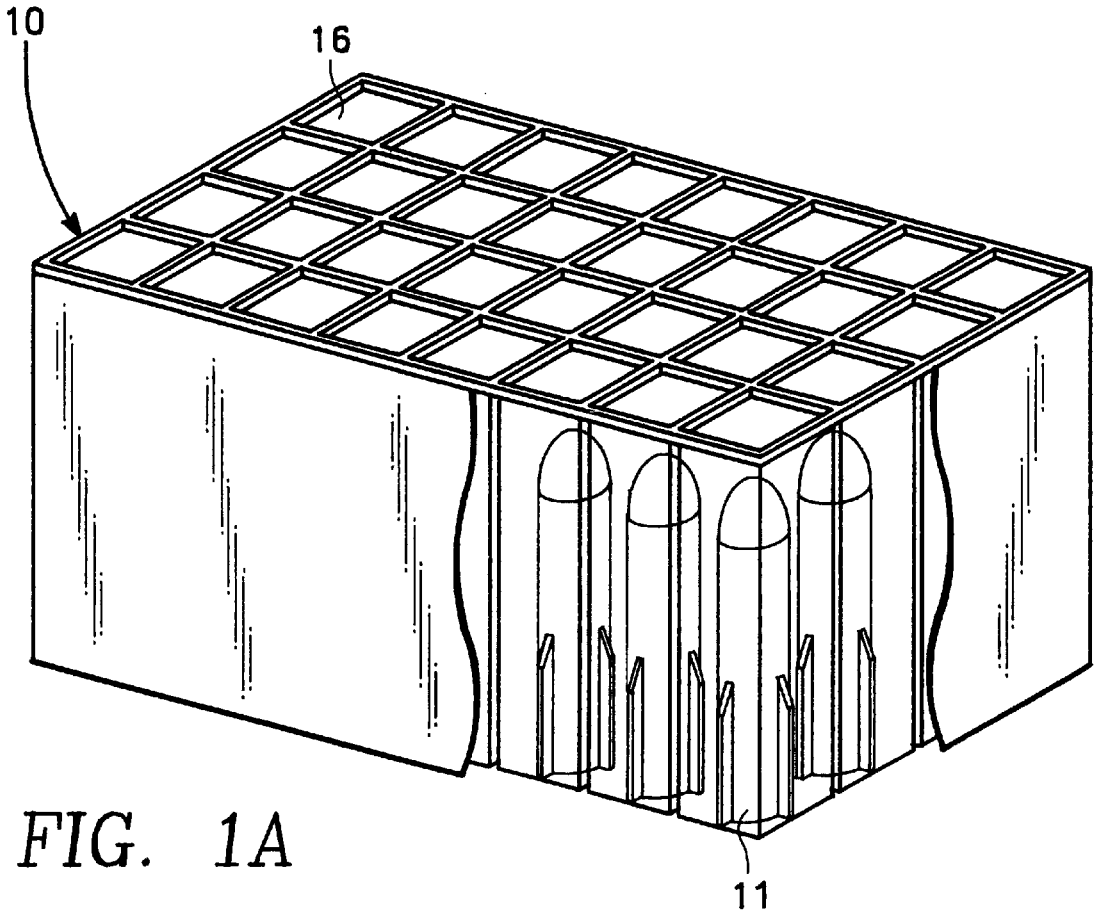
FIG. 1*a* is an illustration of a preferred embodiment of the present invention, which illustrates a tier of a multi-tiered vertical launched multi missile system and the adaptability to a typical missile launch tube.
Figure 1B:
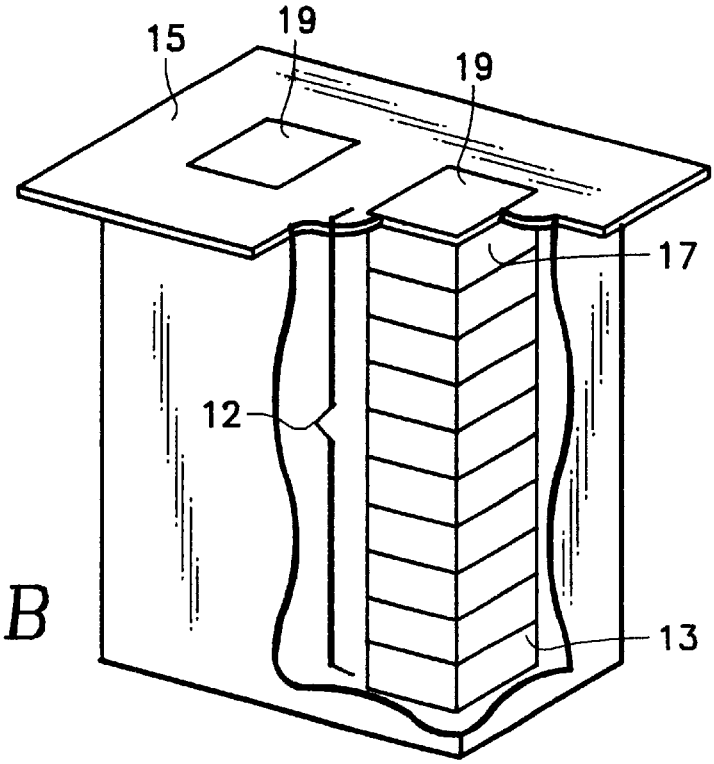
FIG. 1*b* is an illustration of a preferred embodiment of the present invention, which illustrates a multi-tiered vertical launched multi missile system and the adaptability to a ship.
Figure 2:
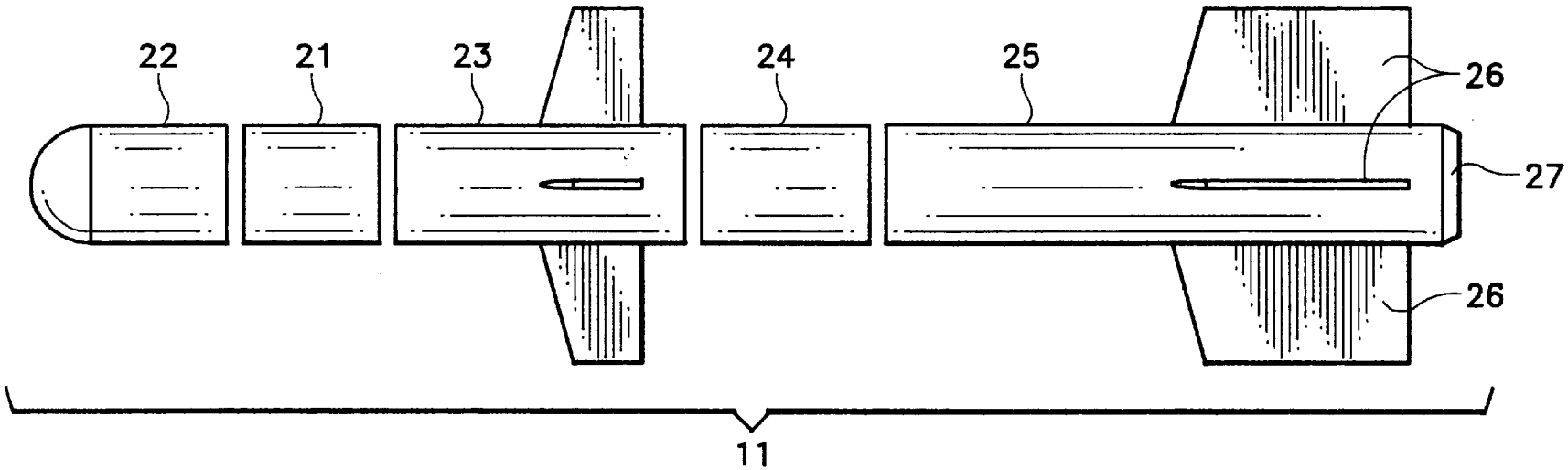
FIG. 2 is an illustration of a preferred embodiment of the present invention, which illustrates a ship self defense missile for use in a multi-tiered vertical launched multi missile system.

The present invention optimizes design characteristic of a standard missile system including airframe, optics, infrared target tracking sensor, command guidance receiver, guidance control systems (GCS), ordnance, rocket motor, airframe, algorithms, signal processing hardware, and power supply to provide a readily replaceable, low cost, low flight velocity, low divert G, light-weight, guided missile, as illustrated in FIG. 2. The front end 22 contains the sensor, GCS, IR FPA, optics signal processor, inertial measurement unit (IMU), tracker algorithm, computer, autopilot, vertical launch interface and power supply. The next section 21 is the command guidance link receiver. The next section 23 is the aero control section that may contain a aero surface angle measurement device and aero control surfaces. The mid section 24 contains ordnance, a safe-arm device and contact fuse. The tail section is comprised of the rocket motor 25 command guidance link antennas 26 and thrust vector/thrust divert control, nozzle and angle measurement device 27. With a general purpose target acquisition system that is not tightly tuned to a particular target signature, any infrared stationary or slow moving surface target may be acquired and attacked. Applicable algorithms for target acquisition of infrared target tracking can be found in publications such as "The Infrared Handbook, 3$^{rd}$ Edition," 1989, William L. Wolfe, Editor, George J. Zissis, Editor, The Infrared Information Analysis (IRIA) Center, Environmental Research Institute of Michigan, and publications such as "Estimation and Tracking:Principles, Techniques and Software," 1993, Yaakov Bar-Shalom, Xiao-Rong Li, Artech House, Boston, Mass. Complex systems of previously known missile systems have been removed or converted including the gimbals, the proximity fuse, the rate and acceleration sensors, the signal processing hardware, the focal plane array, and the optics.

The missile system of the present invention minimizes the size and weight of the missile 11 while producing "adequate" performance. The present invention addresses the need to simultaneously engage multiple targets with multiple missiles, as illustrated in FIG. 4. Since the light weight missile is low cost, multiple missiles 11 can be used to engage a single target 41 for improved probability of kill in a cost effective way thus reducing the need for a near perfect single shot system. The present invention reduces the need for near perfect system effectiveness while obtaining practical operational weight, size, and cost characteristics required to engage a swarm of small boats. The low cost, light weight, guided missile system of the present invention minimizes the performance specifications of the missile 11 to allow the elimination of many of guided missile components previously required in the art.

The vertical launching system of the present invention utilizes a ship's 42 existing vertical launch mechanical and electrical infrastructure while providing a novel and efficient means of storing and rapidly deploying the vertically launched light weight missiles 11. The vertical stack 12 consists of multiple tiers 17, 10 and 13. Each of the tiers 10 holds multiple vertical launched light weight missiles 11 in missile tubes 16. The tiers are stacked vertically in the vertical launch canister 53 to form the vertical stack 12. Each light weight missile 11 is housed in its own missile tube 16. The light weight missiles are deployed from the top tier 17 until no operational missiles 11 remain in the top tier 17, to the bottom tier 13 until no missiles 11 remain in the bottom tier 13, in sequence. As the tiers 10 of the vertical stack 12 are depleted of operational missiles 10 they are ejected out of the open top end of the vertical launch canister 53. Initialization and command and control data are provided to the missile tube 16 and to individual missiles 11 from the existing ship 42 vertical launching infrastructure via a unique vertical launch canister 53 tier 10 controller located within the vertical launch canister 53.

Figure 6:
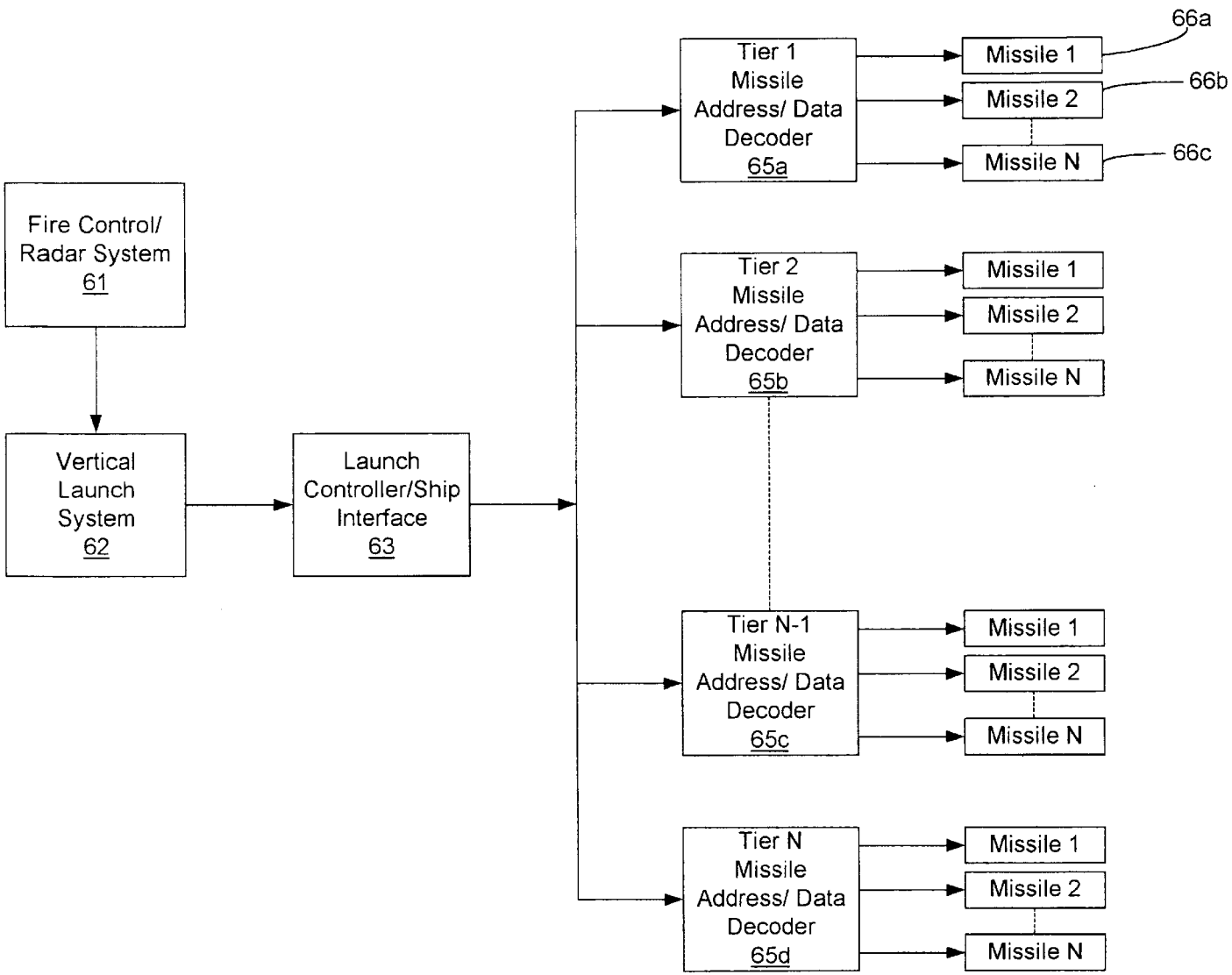
FIG. 6 is a block diagram showing the digital data communications path between the Ship's Fire Control/Radar System to the SSDM missiles prior to launch.

FIG. 6 shows a block diagram of the data path and selection of a particular missile in a particular tier. Prior to engagement of a potential threat navigation data from the Ship's Fire Control/Radar System 61 is passed through a vertical launch system 62, such as the Mk41 Vertical Launch System, to a launch controller/ship interface 63. This data consists of the Ship's heading, Position, Velocity, and quality of data indicators. This is done on a regular interval so that a transfer alignment can be performed between the missiles 1 through N 66*a*, 66*b* and 66*c* and the Ship navigation system. This is done so that each of the missiles 66*a*, 66*b* and 66*c* knows its location, heading, and velocity at launch so each knows which direction, relative to the initial launch location, to fly to reach the target 42. Transfer alignment methods are described in "Transfer Alignment Methods Study For Air Launched Missiles," Contract No. N60530-87-D0154, Date: Apr. 30, 1990, prepared by Strapdown Associates, Inc., Plymouth MN. Upon detection and decision to engage a target the Ship's Fire Control System passes estimated target range, bearing, and velocity data, and possibly optimal ascent trajectory coordinates for the missile 66*a*, 66*b* and 66*c* to fly to prior to pitch over, through vertical the launch system 62, existing infrastructure, to the launch controller/ship interface 63. The data passed is preferably in a digital format. The launch controller/ship interface 63 passes this information to the current ready to fire tier, which will be the tier at the top 65*a* of the vertical stack of tiers tier 1 through tier N 65*a*, 65*b*, 65*c* and 65*d*. The ready to fire tier Missile Address/Data Decoder 65*a* then decodes and passes the address and data to the appropriate missile which may be numbered Missile 1 through Missile N 66*a*, 66*b* or 66*c*, wherein N is a whole number from 2 to 49. Upon receipt of the targeting information and release to fire, the selected missile is fired and exits the ready to fire tier.

FIGS. 1A–3 and 5 are illustrations of the vertical launched missile system of a preferred embodiment of the present invention. The vertical launched missile system includes a vertical launch canister 53, which contains multiple tiers 10, which contain multiple missiles 11. The vertical launch canister 53 fits into the existing vertical launch infrastructure both mechanically and electrically. The vertical launch canister 53 may be loaded with the missile tiers 10 at the factory. In a preferred embodiment of the present invention, the tube utilizes the existing standardized infrastructure in the Mk41 vertical launch system for both mechanical interfaces and electrical interfaces. The vertical launch canister 53 is loaded by crane into the Mk 41 vertical launch tube and interfaces with the standard mechanical interfaces to secure it to the ship 42. The electrical interfaces are connected via the standard connectors. Initialization data is passed from the existing fire control infrastructure to the individual tiers and on to the individual missiles via the integral vertical launch controller located within the vertical launch canister 53. The number of tiers 10 per vertical launch canister 53 could be as high as ten. The number of missiles 10 per tier 11 could be as high as forty-nine. The missiles are fired from the top tier 17 until the top tier 17 is depleted of usable missiles 11 to the lowest tier 13 until it is depleted. Once a tier is depleted it is ejected from the top of the vertical launch canister 53 and a fully loaded tier from below, within the vertical launch canister 53, is elevated to the missile launch position. This can be repeated until all tiers in the vertical stack 12 are depleted. In a preferred embodiment, the rate of fire is expected to be five missiles 11 per second from a tier 17.

Figure 3:
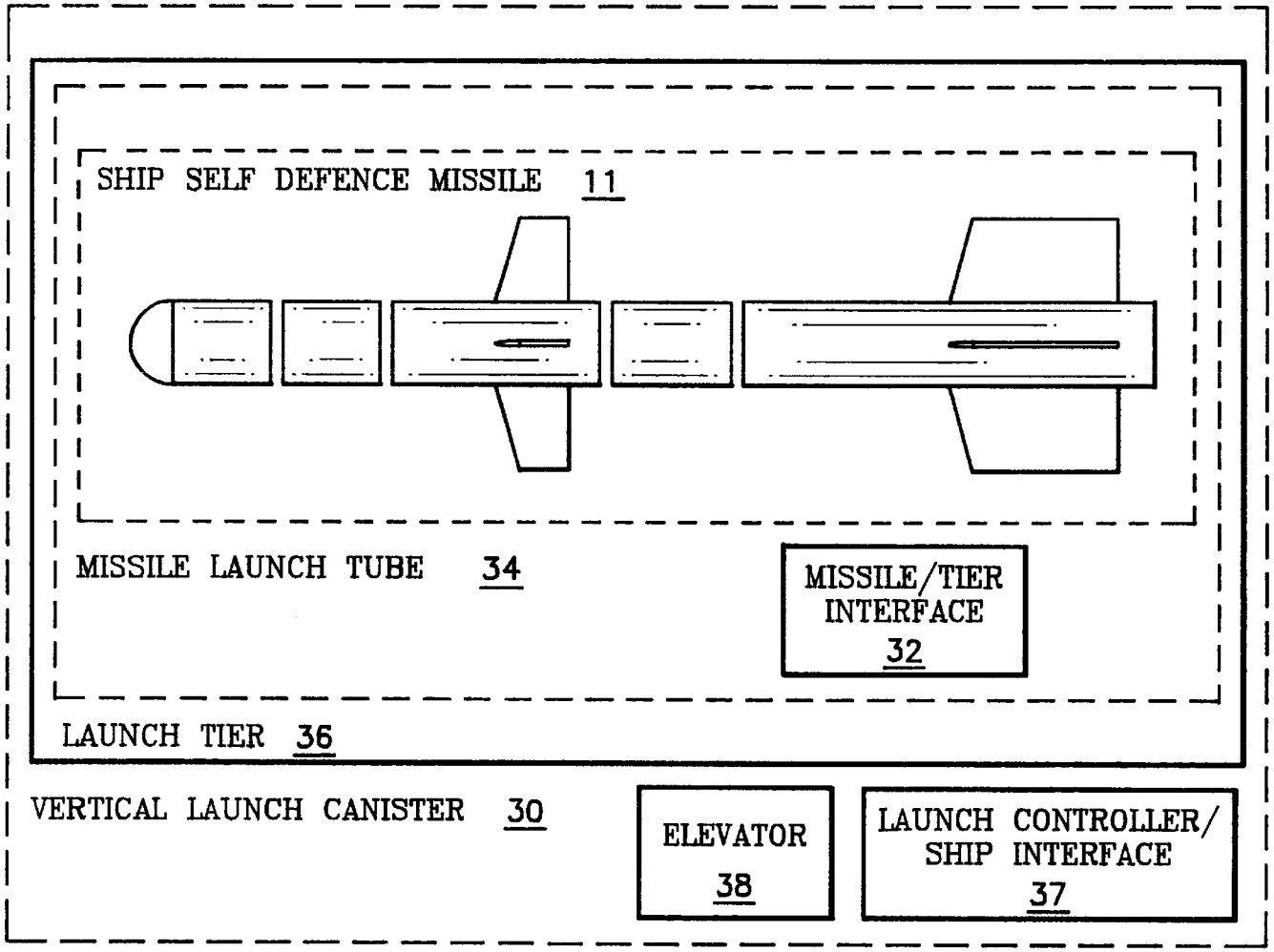
FIG. 3 is a conceptual diagram of a preferred embodiment of vertical launch multi-tiered multi-missile system of the present invention illustrating different components thereof.

Referring to FIG. 3, each tier is ejected in the following manner. Once a ready to fire tier 36 has been exhausted, the Launch Controller/Ship Interface 37 actuates the elevator 38 so that a loaded tier can replace the exhausted ready to fire tier 36, which is always the top most tier. As the elevator raises the loaded tier 36 into position, all tiers move up one tier position within the vertical launch canister 30. A missile 11 is launched from a missile launch tube 34 using the missile tier interface 32.

Figure 5B:
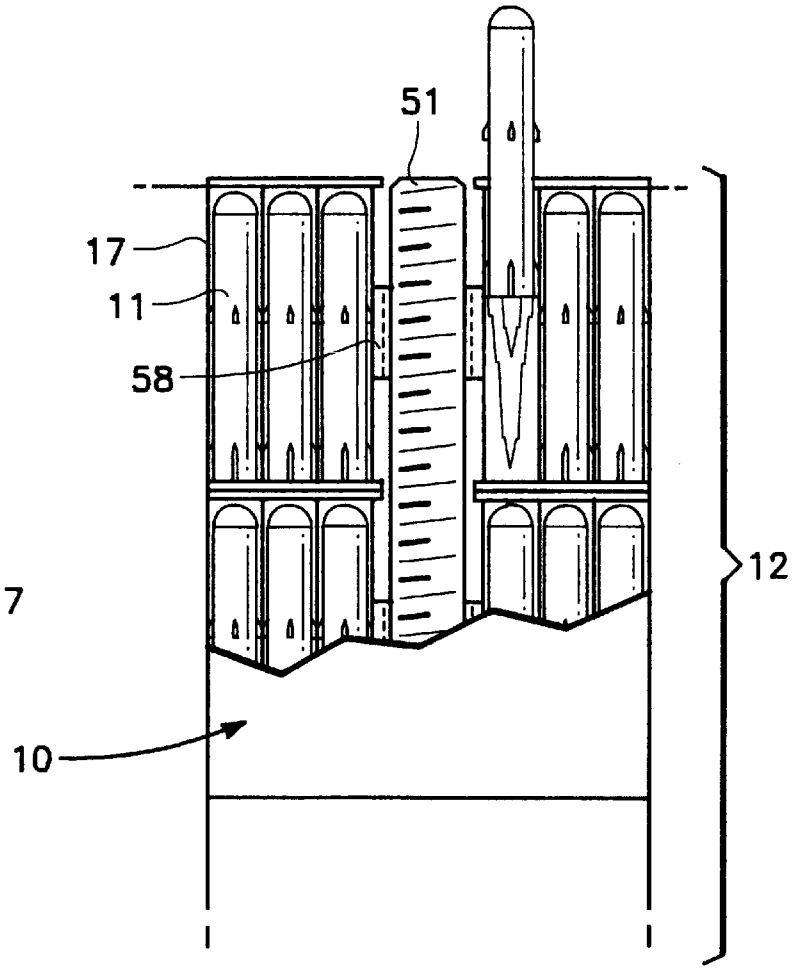
FIG. 5*a* is an illustration of a preferred embodiment of the present invention, which illustrates the elevator mechanism of a preferred embodiment of the present invention.
Figure 5A:
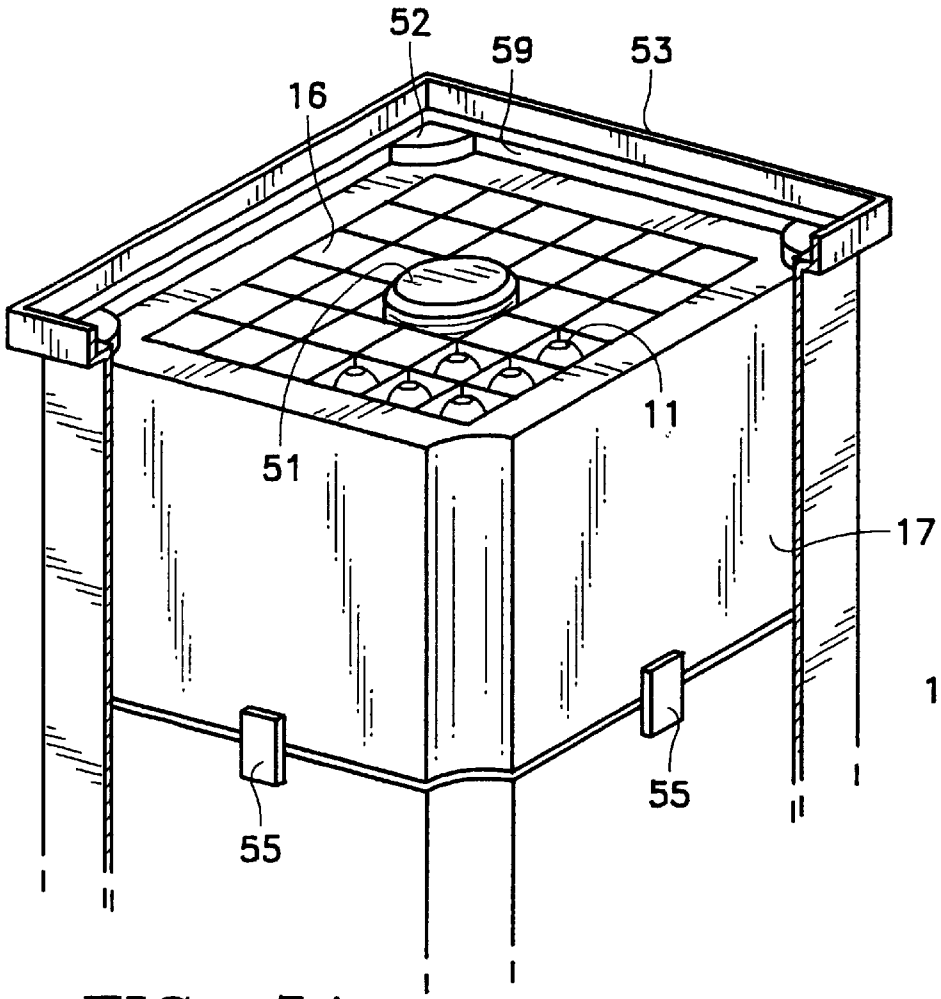

Referring to FIGS. 5*a* and 5*b*, in a preferred embodiment, the exhausted ready to fire tier or top tier 17 is raised to point here it runs off the threads of the jack screw 51, which comprises the major portion of the elevator mechanism, and has exited the end of the vertical launch canister 53 but is still is covering the vertical launch canister 53 exit. Once the loaded ready to fire tier is in proper position, the launch controller/ship interface 37 initiates one of four. explosive charges 55 which are located symmetrically on the base of each tier about the opening for the jack screw 51, which itself is centered on the base of the tier 17. The explosive force of the charge causes the exhausted tier 17 to be ejected in a direction away from the vertical launch canister 53 exit depending on the location of the vertical launch canister 53 relative to the other possible vertical tubes in the vertical launch system.

An elevator mechanism raises the tiers into place. Existing power and low pressure air are utilized to power the elevator. A preferred elevator system works in the following manner and is shown in FIGS. 5*a* and 5*b*. The lift mechanism is composed of a jack screw 51, located at the center of the vertical launch canister 53 which extends the entire length of the vertical launch canister 53 from the elevator drive motor through the top most ready to fire tier 17. Each tier, at the center of the base, has a nut 58 that rides on the jack screw 51. The vertical stack of tiers 12 are raised by driving the jack screw 51 with the elevator motor, which turns, and via friction causes the tiers to be raised. The nuts 58 on the tiers are separated from each other with sufficient distance that any nut/jack screw mechanism for a tier need only handle around 400 pounds of weight, which is the expected maximum weight of a fully loaded tier. At least one tubular guide 52 is located on the interior wall 59 of the vertical launch canister 53 to guide the vertical stack of tiers 12. In a preferred embodiment, each corner of a tier 10 and 17 is cut out to fit around a corresponding tubular guide 52 located in each corner of the vertical launch canister 53. Each tier has a set of bearings in the cutout area that rides on the tubular guide 52 to provide smooth operation during lifting and stability for the jack screw 51 operation. Power for the SSDM Launch Controller/Ship Interface and elevator motor are provided by the MK41 Vertical Launch System. The MK41 Vertical Launch System provides 440 VAC, 400 Hz, 3 Phase power to drive the elevator motor. This power is also used to run the launch controller/ship interface 63, illustrated in FIG.6.

Referring to FIG. 2, the missile of a preferred embodiment of the present invention has an airframe that encloses a strap-down infrared acquisition and tracking sensor in first section 22, a guidance and control system (GCS) 22 including an aero-control section 23 and a command guidance link 21, a thrust vector/or thrust divert control system 27, an ordnance section 24 having a contact activated warhead, and a solid-propellant rocket motor 25. Command guidance link antennas 26 are located in the tail section. The weight, size, and low cost of the missile allow great numbers of them to be housed in a vertical launch canister and deployed at very high rates at swarming boats. The weight of the missile preferably ranges from about 10 pounds or less, more preferably from about 8 pound or less, most preferably from about 6 pounds. There are two possible midcourse guidance update configurations of the missile, which are a command guidance link with the existing shipboard fire control system, or initialization data provided by the shipboard fire control system. In the first case, after launch, the command guidance link guides the missile to some location in space where the missile is commanded to pitch over and acquire the target with the infrared sensor and tracking algorithms. It then guides to the target under its autonomous control. In the second case an estimate of the target position and probable heading and velocity are downloaded from the shipboard fire control system to the missile during initialization prior to missile launch. No command guidance link is utilized in this case. The missile, once launched, autonomously navigates to the estimated location of the target and then pitches over to acquire the target with the infrared sensor and tracking algorithms. It then guides to the target under its autonomous control. Applicable algorithms for target acquisition and track of infrared target tracking can be found in publications such as "The Infrared Handbook, 3$^{rd}$ Edition," 1989, William L. Wolfe, Editor, George J. Zissis, Editor, The Infrared Information Analysis (IRIA) Center, Environmental Research Institute of Michigan, and publications such as "Estimation and Tracking:Principles, Techniques and Software," 1993, Yaakov Bar-Shalom, Xiao-Rong Li, Artech House, Boston, Mass.

The airframe permits stabilized and corrective flight of the missile through its vertical ascent to pitch over to flight to a target. The size of the airframe is suitable for loading multiple missiles side by side on a tier. The airframe, which may include wings and a tail section, is designed to provide a stable air platform to carry the ordnance section having the warhead to the target. Preferably, the airframe comprises a length of from about 24 inches or less, more preferably from about 20 to about 22 inches. The diameter of the airframe also provides suitable transport by an individual, preferably ranging from about 3.0 inches or less, more preferably from about 2 inches to about 2.5 inch. The airframe comprises any suitable light-weight material that provides a sufficiently rigid structure, such as light metal, fiberglass, plastics and/or other compositions, and combinations thereof. Examples of the compositions include aluminum, reinforced plastics, etc, with aluminum being preferred. The minimal vibration of the airframe during flight aids in attaching a strap down an uncooled infrared focal plane array. For example, a 60 mm diameter, 60 cm length light weight missile is sufficiently stable to support a functionally adequate strap down infrared focal plane array. Additionally, the airframe includes aero-control surfaces within the aero-control section along the length of the airframe that may include tail and/or wing sections. Preferably, the aero-control surfaces include from about 2 to about 4 canards, and more preferably from about 3 to about 4 canards. The airframe also includes a thrust vector control or a thrust divert control section at the rear of the airframe so that during the vertical ascent the airframe can be maintained under control for trajectory shaping when the aero control surfaces have minimal effect. When the solid propellant rocket motor burns out the thrust vector control or the thrust divert control are not functional and divert capability is provided by the aero control surfaces.

The uncooled infrared tracking sensor of the present invention includes components of reduced complexity and weight for identifying a target. The complex arrangement previously found in guided missile systems that included such components as a transparent dome, sensor optical system, a focal plane array, focal plane array clock drive and readout electronics, motion sensors, and cryostat are replaced within the present invention. Removal of the cryostat is a significant source of cost and weight savings. This is replaced with an infrared sensor package utilized from the automobile industry. Optics that support the infrared wavelengths comprise the optical system. As the missile remains protected until fired, the reduction in durability of the optics caused by using the optical system is not problematic. The relatively small aperture, causing reduced sensitivity, available to the infrared sensor, is not problematic since the missile will be in fairly close proximity to the target due to guidance from the ships fire control system, when the infrared sensor and its associated algorithms are commanded to acquire and track the target.

The uncooled infrared sensor comprises an electro-optical component, such as those similar to the midwave infrared (MWIR) uncooled staring focal plane array. Preferably, the target tracking sensor comprises a single MWIR spectral band staring focal plane array with approximately 128×128 pixels, such as those commonly used in automotive night vision heads up displays. This reduces cost while maintaining acceptable functioning of the missile.

The infrared focal plane array of the present invention operates at a low frame rate sufficient for target acquisition and tracking. Frame rates preferably comprise a speed of from about 15 Hz or less, as compared to 60 Hz for commercial television. The low frame rate is possible because of the combination of threat target set, the low divert G and flight velocity airframe of the present invention. Low divert G is generally less than 10 G of lateral acceleration. The threat target set comprises stationary or slow moving surface targets. Slow moving targets include straight line travel at a speed of from about 60 mph or less, with direction changes from about 2 g's or less. The low target maneuver capability permits the present invention to incorporate a correspondingly low maneuver performance, such as a speed of from about 500 mph and 4–8 g's, or less, of divert capability. The data update rate, or the infrared focal plane array frame rate, remains correspondingly low due to the low target maneuverability.

A preferred embodiment of the present invention does not utilize the gimbal system found in other guided missiles used to stabilize target tracking sensors. Gimbal systems perform several functions: to isolate the target tracking sensor from the airframe motion, to keep the target in the field of view while allowing the missile to generate an angle of attack, and to keep the target in the field of view while allowing the missile to generate the potentially large angle between the direction the sensor must point to view the target and the direction the missile must point required to implement proportional navigation guidance law. However, the uncooled infrared focal plane array based target tracking sensor of the present invention is mounted directly onto the airframe structure and not on a gimbal. The non-gimbal approach of the present invention comprises a "strapped down" infrared focal plane array.

Gimbal systems provide image vibration isolation from airframe movement. High frequency vibrations of the airframe form an image smear, degrading the image and significantly reducing system performance. Within the present invention, the vibration is mitigated by a short and rigid airframe that limits the bending modes of the airframe, reducing any disruption in the proper operation of the target tracking sensor. Additionally, the uncooled infrared focal plane array containing integration time control of the present invention controls image smear by shortening the integration time.

The present invention flies along a path determined by the ship's fire control system communicating via a command data link, or an estimated path from initialization data so as to arrive at a point in space called an "acquisition basket." Once within the acquisition basket the missile pitches over to view and to acquire and track the target. The lack of look angle capability of the present invention also removes the need for a gimbal mounted infrared focal plane array.

Guided missile systems have generally used a navigation law of proportional navigation. As such, the guided missile predicted an intercept point in space to fly toward rather than continually chasing the target. The relative speeds of the missile and target determined the line of sight angle that the gimbal must turn to keep the target in the field of view (FOV). For non-maneuvering targets the equation becomes correctly solved, and for maneuvering targets, the targets become increasingly stationary in the FOV as the missile decreases its range to target. Accordingly, at the end of missile flight, called the "endgame", few divert Gs were required. The present invention implements a limited proportional navigation solution during the target acquisition and track phase of the fly out. The more accurately that the missile is placed within the acquisition basket the fewer divert G's that are required to intercept the target. Further, since there is no gimbal to provide a search capability reaching the acquisition basket becomes more important than systems that have a gimbal, but this issue is not insurmountable.

The resultant performance limitations of the present invention with the removal of a normally used gimbal system is managed with a lower performance guidance, more accurate fly out to an acquisition basket, and the loss of image vibration isolation. The strapped down infrared focal plane array removes the cost, complexity, size, and weight of the gimbal system, as well as removing the packaging problems related to mounting the infrared focal plane array, the focal plane array drive circuitry, and the A/D converter on the gimbal and a cooling cryostat. The lack of space on the gimbal to mount the support circuits, and problems of drive circuitry and A/D converter being placed off gimbal are resolved with the removal of the gimbal system. The small size of the airframe and non-dynamic threats in the target set also make the removal of the gimbal possible.

The guidance and control system (GCS) directs the missile through the vertical ascent phase, through the fly out to the acquisition basket phase, and to the target. The guidance and control system performs real-time in-flight weapon aim-point corrections from measurements collected by the sensor. Aim-point corrections are performed by changing the missile flight trajectory with aero-control surfaces after vertical launch phase has been completed. The aim-point corrections dramatically improve the probability of impacting the target over unguided missiles and allows the missile to be used at longer ranges. Generally the GCS has a computer, an aero-control section/autopilot, aero-surface position sensors, aero-surface servos, thrust vector control or thrust divert control system and the associated movable nozzle/flapper and the associated angular position measurement device. The GCS computer processes the measurements from the inertial measurement unit and the command guidance link during vertical ascent and fly out to the acquisition basket. The GCS computer then processes measurements from the infrared focal plane array to acquire and track the target. The autopilot of the GCS comprises a program that converts attitude and command link data into guidance commands during the vertical launch and initial fly out phase. The auto pilot and GCS comprise a program that converts target measurements and corrects the flight direction of the missile to intercept the target once the missile has reached the target basket. During the vertical ascent phase the angle position sensors in the thrust vector control system measure the angle of the nozzle or the flapper, the autopilot then commands the nozzle or the flapper to change orientation to rotate the attitude of the missile so as to adjust its trajectory. During the fly out phase to the acquisition basket, aero-surface position sensors measure the position of the aero-surfaces for the autopilot; the autopilot commands the aero-surface servos to generate a torque on the aero-surfaces to alter the flight path of the missile towards the acquisition basket location. During the flight to the target, aero-surface position sensors measure the position of the aero-surfaces for the autopilot, the autopilot commands the aero-surface servos to generate a torque on the aero-surfaces to alter the flight path of the missile towards the target location determined by the uncooled infrared focal plane array. Prior to missile launch from the vertical launcher, the launcher interface of the GCS provides a communications link between the missile and the current tier within the vertical canister with power-up, initialization, and launch command information passed across the fire control system interface. The GCS of a preferred embodiment of the present invention uses a solid state inertial measurement unit (IMU) sensors, incorporating microelectromechanical system (MEMS) technology, to replace classical gyros. Low performance aspects of the solid state sensors may be calibrated by higher performance sensors within the ships fire control system via a transfer alignment.

Ordnance section within the missile may be designed for specific purposes. Preferably the ordnance section comprises a safe & arm (S&A), a contact fuse, warhead detonator, and a warhead. The safe & arm prevents the warhead from detonating before the missile acquires a safe distance from the ship. The contact fuse determines missile impact on the target, and the time to detonate the missile warhead. The warhead detonator is a small pyrotechnic device that explodes to set off the larger charge in the warhead. The warhead is the explosive charge that is designed to explode to cause a fire to start on the target. This is called a pyoforic warhead. Proximity fuses are removed, decreasing the complexity, size and weight of the missile.

The rocket motor of the present invention produces sufficient thrust to lift the missile to a desired height during the vertical ascent phase and then still have sufficient thrust reserve to cause the missile to reach the desired speed and the desired acquisition basket location. Preferably, the rocket motor generates from about 850 mph or less of sustained missile velocity, more preferably from about 500 mph to about 850 mph. The low velocity rocket motor is functionally adequate against stationary and/or low velocity targets traveling from about 40 mph or less with target maneuverability of less than about 2 g's, and of those the targets that are within 5 miles of the point of launch. Examples of the rocket motor of the present invention include a 5 to 6 pound lightweight carbon fiber rocket motor.

The present invention comprises minimal algorithm complexity due to throughput afforded by the limited signal processor hardware that can be packaged in such a small space. Several factors reduce algorithm complexity. First, the target location is known by the ships fire control system so the missile is directed to the vicinity of the target. FIG. 7 shows the geometry of the engagement. Since the ship fire control system is providing targeting data to the SSDM missile via a data link, the complication of initial acquisition of the target by the SSDM missile is alleviated. A description of the SSDM missile flyout follows. The ship knows its own position, velocity, and heading since it has onboard a navigation system. The selected SSDM missile knows its position, velocity and heading since it has performed a transfer alignment to the ship's navigation system. The ships fire control/radar system 61 estimates the target position, velocity, and bearing and passes this information to the selected SSDM missile 66*a*, 66*b* or 66*c* through the vertical launch system 62, the launch controller/ship interface 63 and the missile address/data decoder of a tier 65*a*, 65*b*, 65*c* or 65*d*, as illustrated in FIG. 6. The fire control/radar system 61 also passes along an optimal vertical ascent trajectory for the SSDM missile 66*a*, 66*b* or 66*c* to fly to a point in space where it pitches over to look for the target with the infrared detector. The infrared detector field of view is large enough to allow for target position uncertainty reported by the ship's fire control/radar system 61 and for SSDM missile navigation error associated with the ascent and pitch over at a particular position in space. A field of view of about 12 degrees should be adequate to cover the target uncertainty region at a missile to target slant range of 3600 feet and altitude of 1500 feet, for a missile flight time of 45 seconds. Once the SSDM missile 66*a*, 66*b* or 66*c* is fired the fire control/radar system 61 will update it via a data link on the target's most recent velocity, bearing and position estimates so that the missiles ascent trajectory can be modified as necessary to place the SSDM missile 66*a*, 66*b* or 66*c* at the appropriate location in space to pitch over and to look for the target with the infrared detector. Once the SSDM missile 66*a*, 66*b* or 66*c* pitches over and is pointing at the target, the acquisition and track algorithms, internal to the missile 66*a*, 66*b* or 66*c* are used to generate guidance commands that steer the missile 66*a*, 66*b* or 66*c* to the target 42. Second, the algorithm complexity is reduced since the target contrast against and ocean background in the infrared is typically quite large and the close proximity of the missile during pitch over enhances this. Third, the resolved targets allow the use of 2-D edge detection, i.e., the missile system only processes a small region around the target since the target and the missile are slow moving relative to the velocity of the missile. Acquisition and track algorithms can be found in reference texts such as "The Infrared Handbook, 3$^{rd}$ Edition," 1989, William L. Wolfe, Editor, George J. Zissis, Editor, The Infrared Information Analysis (IRIA) Center, Environmental Research Institute of Michigan, and publications such as "Estimation and Tracking:Principles, Techniques and Software," 1993, Yaakov Bar-Shalom, Xiao-Rong Li, Artech House, Boston, Mass.

Signal processing hardware throughput requirements are determined by the class of algorithms implemented and the target and missile dynamics. Both the class of algorithms implemented and the target and missile dynamics are limited to minimize size and weight requirements. The signal processing hardware requirements are minimized by requiring flying to a location directed by the ship's fire control system, bright extended targets against the cool ocean in a look down attitude, and by restricting the airframe performance through selection of the appropriate targets. The digital electronics preferably have low voltage devices, preferably from about 2.3 volts to about 3 volts, to limit power consumption. The signal processing hardware preferably is limited to 1 or 2 commercial-off-the-shelf (COTS) microprocessors.

The power supply of the present invention may include any energy source that permits the proper functioning of the missile. Preferably, the energy source comprises a battery having lifetime of from about 30 seconds power or more, more preferably from about 30 seconds to about 60 seconds, and most preferably from about 45 seconds to about 60 seconds. Power requirements are reduced with the power limited requirements of the signal processing hardware.

The cost of the missile of the present invention is sufficiently low that a defective missile would not be launched and ejected with the depleted tier. Cost of the airframe may be as low as $2. Power sources may cost approximately $50, with the small rocket motor size and relatively low performance also decreasing the cost of the missile. The overall cost of the missile system of the present invention ranges from about 2.5% to about 5% of the cost of currently used guided missile systems. As such, the missile of the present invention may be stored in the vertical launch tube and fired in salvos, if required, at swarms of small boats.

Referring to FIGS. 1*a*, 1*b*, 5*a* and 5*b*, up to forty-nine guided ship self defense missiles 11 of the present invention can be loaded onto a single tier 10 of the present invention. Up to ten tiers in a vertical stack 12 can be loaded into a vertical launch canister 53. This configuration allows for one vertical launch canister 53 to contain up to 490 missiles 11 for ship self defense. Once the ship fire control/radar system has determined that a small boat is a threat, the threat can be very rapidly engaged by launching salvos of the ship self defense missiles, if required. The ship's fire control/radar system directs the missile to a location in space such that the missile can acquire the threat target with its uncooled infrared detector and tracking algorithms. The missile then tracks and guides to the target. A very high rate of fire can be accomplished with the large numbers of missiles available for firing. Use of existing ships infrastructure is incorporated to the greatest extent possible.

The foregoing summary, description, example and drawing of the invention are not intended to be limiting, but are only exemplary of the inventive features which are defined in the claims.

What is claimed is:

1. A system for vertically launching missiles from a ship, comprising:

a plurality of tiers having a top tier and a bottom tier, wherein each of said plurality of tiers supports a plurality of missiles;

a launch canister having an interior wall, wherein said plurality of tiers form a vertical stack in said launch canister;

launch means for selectively launching at least one of said plurality of missiles from said top tier;

means for ejecting said top tier, wherein said top tier is ejected after each missile of said plurality of missiles contained within said top tier is launched;

vertical movement means for raising and lowering said plurality of tiers within said launch tube, wherein said vertical movement means raises a next tier of said vertical stack into a position to launch at least one of said plurality of missiles contained within said next tier after said top tier is ejected.

2. The system of claim 1, wherein each missile of said plurality of missiles comprises:

a guidance system having an aerocontrol section, wherein each missile of said plurality of missiles has a flight path and an attitude and wherein said aerocontrol section manipulates the flight path of said missile to a target;

a thrust divert section, wherein said thrust divert section manipulates the attitude of said missile during vertical ascent;

a computer hardware package, wherein said computer hardware package adjusts said aero-control section in relation to measured values once the target is tracked, adjusts said thrust divert section to an attack attitude during the vertical ascent, and adjusts aero-control surfaces to change the trajectory of said missile based on command guidance link updates;

a strap-down uncooled infrared acquisition and tracking sensor electrically connected to the computer hardware package, wherein said sensor provides a measured value to the computer hardware package;

a contact actuated ordinance section; and, a solid-propellant rocket motor of sufficient power to project said missile at a speed and over a distance to enable said guidance system;

a command guidance link, wherein said command guidance link receives mid course guidance updates from a fire control system to direct said missile to an acquisiton basket.

3. The system of claim 2, wherein said missile comprises a length less than about 24 inches.

4. The system of claim 2, wherein the missile comprises a weight of from about 8 pounds to 10 pounds.

5. The system of claim 2, wherein said sensor comprises an uncooled infrared imaging electro-optical component.

6. The system of claim 2, wherein said aerocontrol section comprises from about 2 canards to about 4 canards.

7. The system of claim 2, wherein said aerocontrol section comprises from about 3 canards to about 4 canards.

8. The system of claim 2, wherein said aerocontrol section has a tail section.

9. The system of claim 1, wherein said plurality of tiers comprises 10 tiers.

10. The system of claim 1, wherein said plurality missiles comprises 49 missiles.

11. The system of claim 10, wherein the electro-optical component has an optics section having infrared compatible optics.

12. The system of claim 1, wherein said vertical movement means comprises:

a jack screw having threads threaded through each of said plurality of tiers, wherein said jack screw rotates to raise and lower said vertical stack;

an elevator motor, wherein said elevator motor supplies power to rotate said jack screw; and at least one tubular guide on the interior wall of said launch canister, wherein each of said plurality of tiers rides each of said at least one tubular guide.

13. The system of claim 12, wherein said vertical movement means further comprises at least one set of bearings between said at least one tubular guide and each of plurality of tiers, wherein said at least one set of bearings reduces friction between said at least on tubular guide and each of plurality of tiers.

14. The system of claim 1, wherein said means for ejecting said top tier comprises a set of explosive charges on each of said plurality of tiers, wherein said vertical movement means dislodges said top tier and said set of explosive charges detonate to eject said top tier away from said launch canister.

15. The system of claim 1, further comprising a vertical launch infrastructure in said ship, wherein said launch canister is adapted to launch each of said plurality of missiles from said vertical launch infrastructure.

16. The system of claim 1, wherein said each of said plurality of tiers comprises a rectangular shape having four corners and wherein each of said four corners rides a tubular guide.

17. A method of vertically storing a plurality of missiles and deploying each of said plurality of missiles to a target comprising the steps of:

setting a plurality of tiers having a top tier in a launch canister to form a vertical stack, wherein each of said plurality of tiers supports a portion of said plurality of missiles;

elevating said vertical stack until the top tier is in a fire position;

sending initialization data from a fire control system to a first missile in said top tier;

vertically ascending said first missile to a desired height;

flying out said first missile to an acquisition basket as directed by a command guidance link;

altering a flight path of said first missile as required to get to the acquisition basket;

acquiring the target; and altering the flight path of said first missile to guide to the target based on an uncooled infrared detector and tracking algorithms.

* * * * *